US006560788B1

(12) United States Patent
Beltrani

(10) Patent No.: US 6,560,788 B1
(45) Date of Patent: May 13, 2003

(54) SWIMMING OR DIVING GOGGLES

(75) Inventor: Giovanni Battista Beltrani, Genoa (IT)

(73) Assignee: Technisub SpA, Genoa (IT)

( * ) Notice: Subject to any disclaimer, the term of this patent is extended or adjusted under 35 U.S.C. 154(b) by 0 days.

(21) Appl. No.: 09/869,380

(22) PCT Filed: Dec. 28, 1999

(86) PCT No.: PCT/IT99/00425

§ 371 (c)(1),
(2), (4) Date: Oct. 9, 2001

(87) PCT Pub. No.: WO00/38789

PCT Pub. Date: Jul. 6, 2000

(30) Foreign Application Priority Data

Dec. 29, 1998 (IT) ..... TO98A1092

(51) Int. Cl.[7] ..... A61F 9/02
(52) U.S. Cl. ..... 2/428; 2/430
(58) Field of Search ..... 2/428, 430, 439, 2/440; 351/43

(56) References Cited

U.S. PATENT DOCUMENTS 5,777,712 A * 7/1998 Sansalone ..... 351/43
5,915,541 A * 6/1999 Beltrani ..... 2/430

* cited by examiner

*Primary Examiner*—John J. Calvert
*Assistant Examiner*—Katherine Moran
(74) *Attorney, Agent, or Firm*—Sughrue Mion, PLLC

(57) ABSTRACT

Goggles for swimming or diving (1) comprising a frame (2) formed from a substantially flexible annular body made in a single piece with a surround (8) capable in use of being applied hermetically on the user's face, and a lens (3) shaped according to a cylindrical surface with variable radius of curvature. The surround (8) has an annular shape that is substantially a horizontal figure-of-eight, which describes a single continuous perimeter surrounding the user's eyes, and lens (3) is formed from a substantially flexible single sheet, the peripheral edge of which is embedded hermetically by simultaneous moulding in frame (2).

8 Claims, 2 Drawing Sheets

SWIMMING OR DIVING GOGGLES

This is a National Stage entry under 35 U.S.C. §371 of Application No. PCT/IT99/00425 filed Dec. 28, 1999, and the complete disclosure of which is incorporated into this application by reference.

BACKGROUND OF THE INVENTION

The present invention relates to goggles for swimming or diving.

An extensive range of types of goggles for swimming is widely available commercially, the successors of the Polynesian or Japanese goggles from the start of the twentieth century, and these are characterized by a construction consisting essentially of two eyepieces that are completely separate. Each eyepiece consists essentially of a flat or curved lens, and a soft ring in which the lens fits hermetically, and rests with its annular rear edge on the immediate periphery of the eye and in some way or other inside the orbital cavity. The eyepieces are joined together by a flexible central bridge, which can also be adjustable. These goggles are provided with an elastic headband of adjustable length.

THE BACKGROUND ART

An example of goggles of this type is described and illustrated in U.S. Pat. No. 5,524,300.

Despite the fact that they are used very widely, swimming goggles of this type have two serious shortcomings, which cannot be eliminated as they are inherent in the design.

The first shortcoming consists of optical distortions due to refraction in water. This shortcoming arises from the fact that nothing is provided for the purpose of compelling the two lenses to take positions, if flat, on a single common plane and, if curved, following a single permanent surface of curvature that is predetermined by design. Once the goggles are being worn and the eyepieces are resting in the orbital cavities of the user, it is inevitable that the lenses will be positioned more or less at an angle, in the least unfortunate case with the respective normals lying in a single horizontal plane or, much more often, crooked on account of different angular positioning of the eyepieces in the orbits. In all cases there is doubling of vision into two images because the directions of virtual vision are different from the real directions, with the result that during use, the user is subject to a very troublesome sensation of nausea.

The second shortcoming consists of painful, non-hermetic orbital support of the two eyepieces. The fact that the two eyepieces rest on soft anatomical regions inside the orbital cavities makes the seal inefficient precisely because the respective rings do not have a solid contrast, unless the tension of the headband is exhausted. The effect is in any case painful, and certainly harmful to the health of the eye, in that it contributes to restriction of superficial blood circulation, and alteration of the values of ocular pressure. In the long term, from the medical standpoint this effect could become dangerous.

To avoid the two shortcomings described above, the applicant has proposed goggles of an entirely different type for swimming or diving, described in European patent application EP-A-0824029. These goggles contain a double (or theoretically also single) lens shaped according to a cylindrical surface with substantially rectilinear vertical generating lines with progressively variable radius of curvature, much greater corresponding to the front portion, and less corresponding to the lateral portions; a frame carrying the lens is shaped and arranged substantially according to the same cylindrical surface of the said lens; and a seal carried by the frame which can, during use, be applied with a tight seal on the user's face, the arrangement being such that during use the lens is held very close to the surface of the user's face.

In short, the characteristic features of the design of the goggles according to document EP-A-0824029 can be summarized as follows:

- a lens that is substantially rigid (theoretically single but in practice formed from an assembly of two lenses held tightly together by a rigid supporting structure), with a curvature that has a quite precise geometry similar to a cylindroid with continuously variable radii and vertical generating lines, almost flat in the zone between the two optical axes and conversely with large radius of curvature in the two peripheral zones, with joints without an edge between the various zones of the lens, capable of providing an extremely panoramic visual field, free from discontinuities through the absence of dihedrals, without aberrations and refractive defects in the central zone, where the eye is perfectly capable of detecting optical imperfections, and in which the zones with strong refractive effect are relegated to the outermost right and left zones of the lens, where the eye is only capable of seeing indistinctly and so is not disturbed by refractive defects;
- support on the face which, compared with an ordinary underwater mask, has a greatly reduced total area, and if compared with that of the traditional swimming goggles with binocular support is completely outside of the two orbital cavities, with the following advantages:
  - a) easy and secure sealing, since the support bears upon bony zones (forehead, cheekbones, nose) or on the compact facial muscles (cheeks);
  - b) no painful effect, and especially no adverse effect on the blood circulation and on ocular pressure even if considerable tension of the headband is required.

However, goggles of this type with rigid lens with predetermined cylindrical surface and very close to the surface of the user's face, though completely solving the two aforementioned problems of the traditional binocular goggles, still have the following drawbacks.

Firstly, the advantages presented above are achieved by means of a relatively expensive construction, fully described and illustrated in the aforementioned European patent application EP-A-0824029, essentially comprising three components (pair of lenses+soft body that surrounds them and is supported on the face+plastics frame ensuring rigidity and hermeticity), assembled together by two lateral buckles for the headband. This construction requires expensive moulds, because jointed assembly of the various parts of the goggles requires the said moulds to have moving parts, and exceptional accuracy. Furthermore, sophisticated and controlled moulding techniques are required (abnormal shrinkage or fins can prevent connections within tolerance), and manual assembling is required, which cannot be automated and is therefore quite costly, because the soft body for surrounding the lens and for support on the user's face cannot be manipulated by robots.

Secondly, although from the design standpoint the transparent element of the goggles really can be formed by a single lens, in practice the construction of the goggles makes this solution difficult to achieve except at high cost. In practical, commercial application of the goggles in question we are therefore essentially compelled to use a configuration with two lenses, each enveloped in its own annular rubber+plastics surround, though the result is inferior aesthetically to what would be desired on account of the presence, in the central zone between the two lenses, of a vertical bridge. Moreover, to guarantee the necessary rigidity of the assembly made up of the two lenses, the structure for connection and torsional-flexural stiffening between the two lenses is relatively heavy and, as already explained, expensive to manufacture.

SUMMARY OF THE INVENTION

The aim of the present invention is to make goggles of the type specified above which, while maintaining their advantages in terms of visual efficiency and user comfort, make it possible to eliminate the aforementioned shortcomings.

According to the invention, this aim is achieved essentially owing to the following combination of characteristics:

- the frame is formed by a substantially flexible annular body made in one piece with the aforementioned surround by injection moulding of an elastomeric and preferably thermoplastic material,
- the surround has an annular shape that describes a single continuous perimeter, substantially a horizontal figure-of-eight which is not closed at the centre, encircling both of the user's eyes when in use, and
- the lens consists of a substantially flexible sheet whose peripheral edge is formed with a large number of through-holes, and which is embedded hermetically in the said frame by being moulded simultaneously with the latter.

In other words, the goggles according to the invention are constituted of a single piece formed from a flexible lens; curved according to a progressive geometry described mathematically in the previously mentioned European patent application EP-A-0824029; embedded by simultaneous moulding in an integral soft body, formed by injection of elastomeric or thermoplastic material using a suitable mould, shaped so as to rest on the face describing a single continuous perimeter, on the anatomical sequence of left forehead-temple-cheekbone-cheek/root of the nose/right cheek-cheekbone-temple-forehead of the user.

With this solution, the functional effects that are typical of the goggles according to document EP-A-0824029 are maintained, but the following additional advantages are provided:

- economical manufacture, both with regard to the capital cost of moulds and with regard to the technology of simultaneous moulding of lens and frame,
- elimination of any stages of manual assembly,
- support on the nose that is neither troublesome nor harmful, and with absolute hermeticity,
- complete panoramic vision, also without discontinuities in the central zone of the lens.

Moreover, the flexibility of the assembly consisting of lens and frame, which is gradual and is without sharp changes in viewing angle that might cause discontinuities in underwater vision, permits simple adaptation to faces of different widths.

The lens can conveniently be single, but it can also be formed from two parts that are separate but rigid in flexure and torsion between themselves.

BRIEF DESCRIPTION OF THE DRAWINGS

The invention will now be described in detail with reference to the accompanying drawings, which are supplied purely as a non-limitative example, in which.

DETAILED DESCRIPTION OF THE INVENTION

Figure 1:
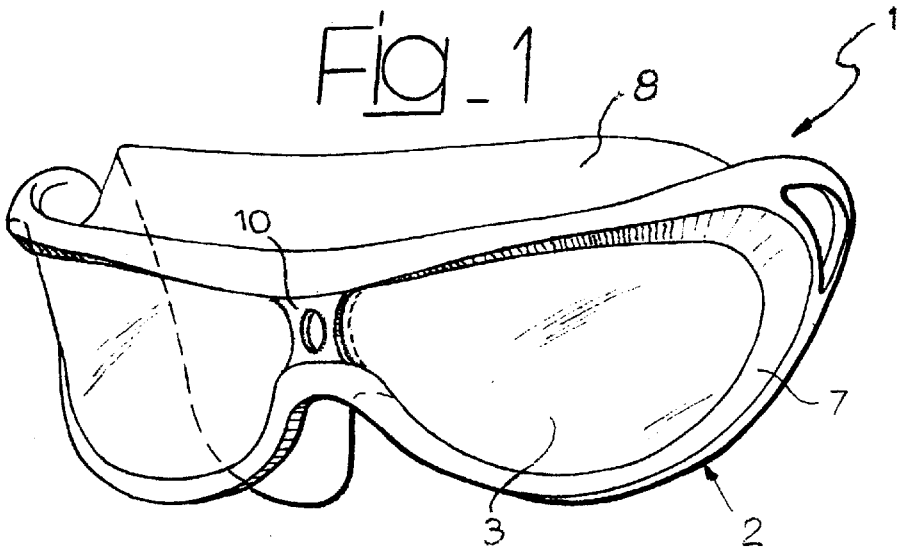
FIG. 1 is a schematic perspective view of goggles for swimming or diving according to the invention.
Figure 2:
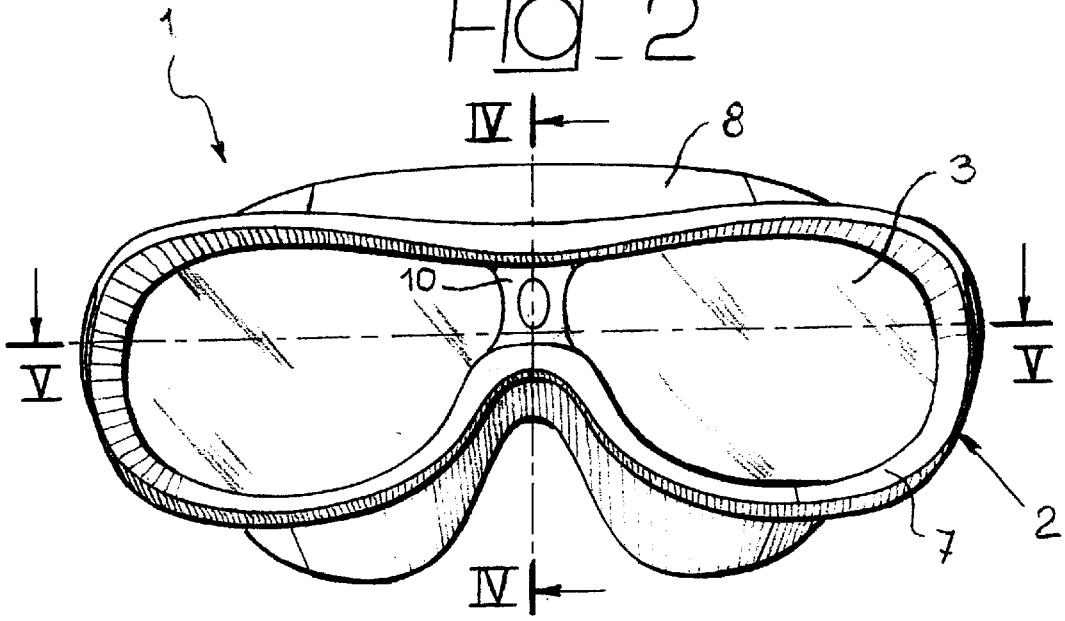
FIG. 2 is a front view of FIG. 1.

In the drawings, goggles for swimming and diving according to the invention are designated in their entirety as 1. The goggles 1 consist of just two components: a frame 2 and a lens 3, both flexible and permanently joined together hermetically by the means explained in the following.

Figure 5:
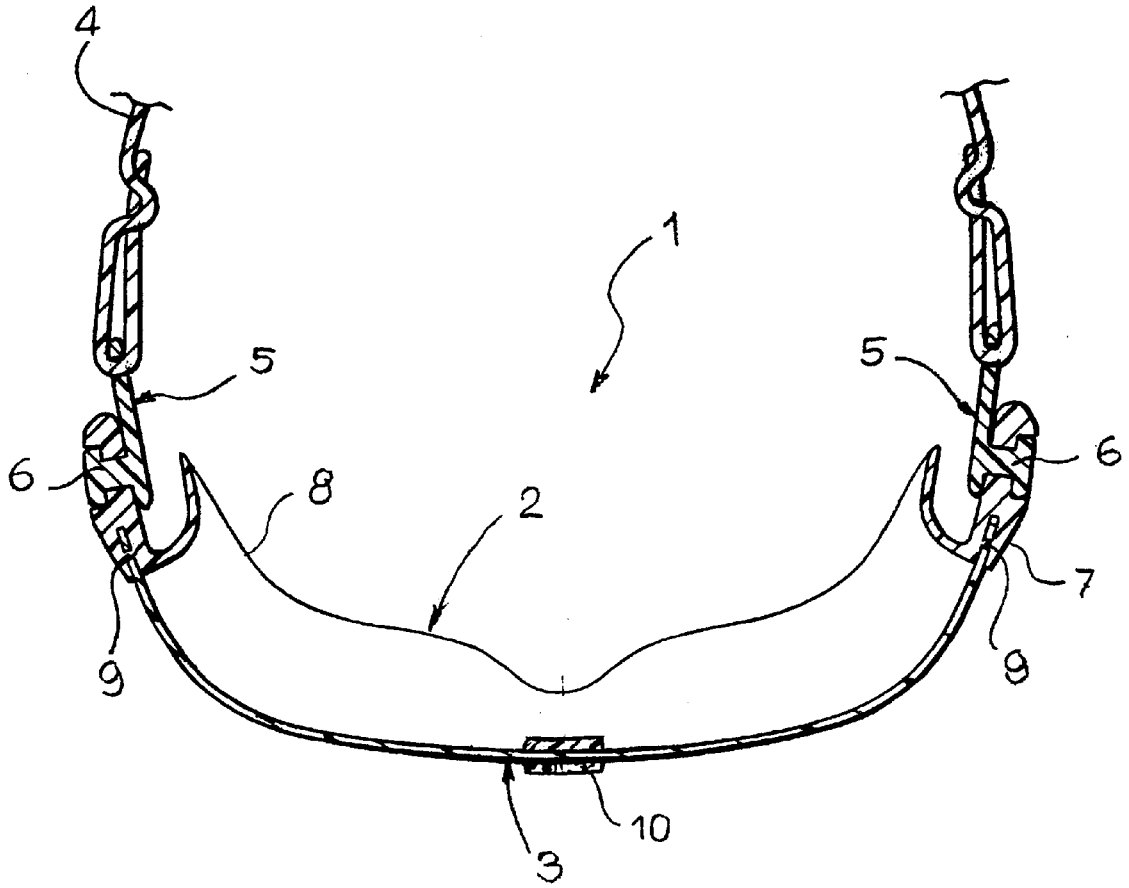
FIG. 5 is a horizontal section through line V—V of FIG. 2.

The goggles 1 are provided with a headband 4, shown partially in FIG. 5, formed from an elastic band of a construction that is resistant to chlorinated water and sea water, the ends of which can be joined to the sides of frame 2 directly or, as in the case of the example shown, by means of a pair of buckles 5 fixed to frame 2 by button fasteners 6 in a single piece or in two pieces joined together by a snap fit. Headband 4 can be provided with a system for length adjustment of any conventional type or alternatively of the type described and illustrated in European patent application EP-A-0892666 in the name of the same applicant.

As an alternative, headband 4 can consist of a rubber band with indented ends, of the type normally employed for underwater masks, with two adjusting buckles positioned at the ends of frame 2.

Figure 4:
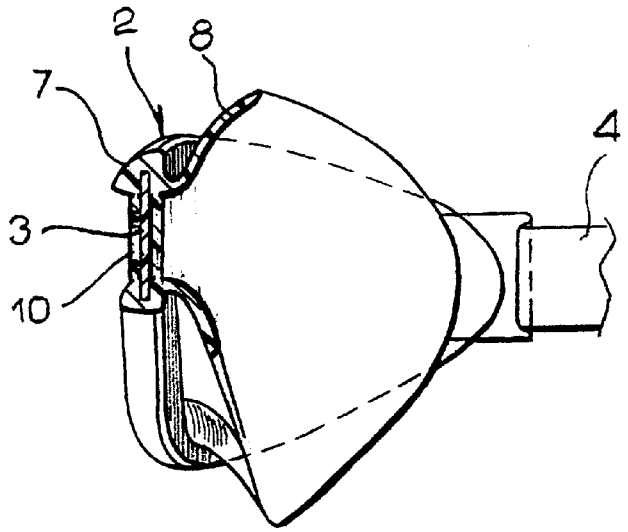
FIG. 4 is a vertical section through line IV—IV of FIG. 2.

The said frame 2 consists of a soft body of elastomeric and preferably thermoplastic material, PVC being suitable, with a relatively thick front portion 7, of C-shaped cross section and less flexible, and a rear portion 8 that is softer, more flexible and more elastic. This rear portion 8 defines a one-piece surround shaped so as to be supported on the user's face on a single perimeter on the forehead/temples/cheeks/root of the nose zone, completely relieving the orbital cavities from any pressure and also being adaptable to faces of different widths, owing to the flexibility of the lens 3, which will be discussed later. In practice the surround defined by the rear portion 8 is substantially a horizontal figure-of-eight, not closed at the centre, i.e. it is formed from two lateral lobes joined at the top by a straight or slightly curved portion and at the bottom by an inverted-U portion. This rear portion 8, as is clear from FIGS. 4 and 5, has a much thinner section than the front portion 7, is therefore shaped as a single ring squeezed vertically between forehead and nose, and instead of being supported painfully by two annular zones within the orbital cavities of the user—as in the case of conventional swimming goggles with two eyepieces—it is supported painlessly and with a perfect seal on the perimeter forehead-temple-left cheekbone and cheek-root of the nose-cheekbone and right cheek-right temple-forehead of the user.

As explained previously, the whole of frame 2 can be made from any elastomeric thermoplastic material (plasticized PVC, thermoplastic rubber, polyurethane etc.) or vulcanizable material (natural or synthetic rubber, neoprene, EPDM, solid or liquid silicone rubber, etc.).

Preferably, but not necessarily, frame 2 is moreover formed integrally with a vertical central bridge 10 situated between the concavity of the central zone (nose) and any slight concavity of the forehead, on both faces, inner and outer, of lens 3. The function of this bridge 10 is to provide further stiffening of the structure of the goggles.

Lens 3 can conveniently be of a single piece, as in the case of the example shown, but can also be formed from two parts that are separate but are stiff in flexure and torsion between them owing to the construction of the frame 2 with the associated stiffening elements.

The single-piece lens 3 in the example is shaped as a "domino" or eye-mask, and is obtained by injection moulding or preferably by cutting from sheet and heat-forming, or by casting in a mould. Preferably it consists of an unbreakable organic material (polycarbonate; cellulose acetate or propionate; CR 39) which may be submitted to treatments for fogging resistance, scratch resistance, mirroring, coloration and UV absorption as well as other possible processing for endowing the sheet with phototropic, polarizing or other properties.

Lens 3 is curved according to the progressive geometry described in the aforementioned European patent application EP-A-0824029, i.e. it has a cylindroid shape with substantially rectilinear vertical generating lines and radius of curvature in the horizontal plane that is continuously variable, much greater corresponding to the central zone and progressively less corresponding to the sides. This particular curvature, combined with the very short distance between lens 3 and the eyes of the user, ensures that in use, vision in water is not doubled and there is complete absence of defects of refraction in the central zone of the goggles 1.

It should be pointed out that the term "substantially rectilinear vertical generating lines" is to be understood as valid except for a very slight spherical curvature possibly resulting from the heat-forming technology. The maximum limit of this defect is to be considered as within a radius of curvature equal to 100 mm.

Lens 3 is moderately flexible, so as to permit variations in width of the goggles 1, thus making them adaptable to faces of different widths. This flexibility can be reduced or otherwise controlled by the possible presence of transverse stiffening elements, such as, in addition to the central bridge 10 of frame 2, a partial front arch or a (complete or partial) peripheral encircling element incorporated in the front portion 7 of frame 2. These stiffening elements, not shown in the drawings, can be fitted to the body of goggles 1 by mechanical mounting, or more conveniently by embedding during simultaneous moulding.

Figure 3:
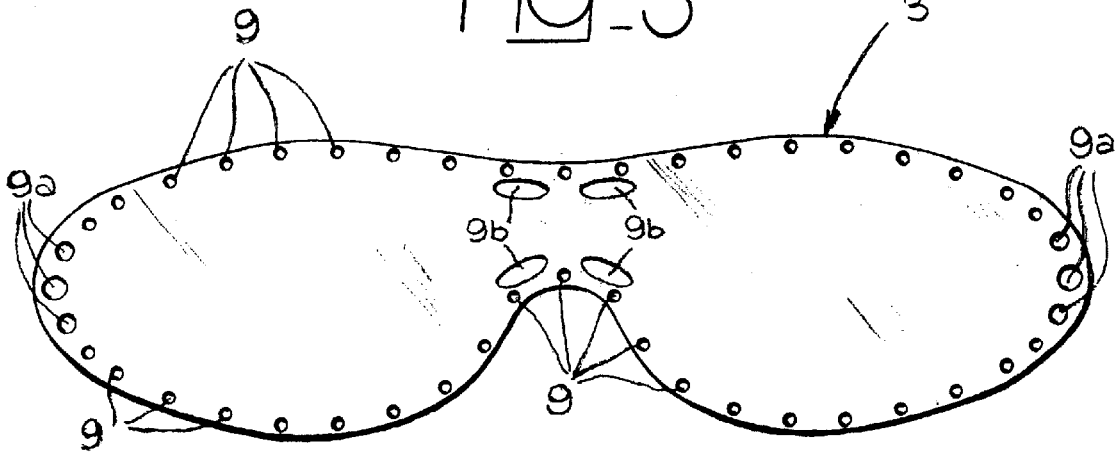
FIG. 3 shows a top view of the lens of the goggles before it is applied to the frame.

As shown in FIGS. 3 and 5, the lens 3 is provided, along its outer perimeter, with small through-holes whose function, as will be explained later, is to improve the permanent joint with the front portion 7 of frame 2. The holes arranged to correspond to the ends of lens 3, indicated by 9*a* in FIG. 3, can have a greater diameter than that of the other holes 9. The holes arranged to correspond to the central zone of lens 3, indicated by 9*b*, can be even larger and can be in the shape of elongated slots. According to a variant that is not shown, holes 9 can be replaced by notches of omega shape, and in addition the peripheral shape of lens 3, to which the said holes are made to correspond, can be prepared by the application of a primer which performs the function of permitting, during the process of manufacture of goggles 1, gluing to the elastomeric material of frame 2.

Preferably the lens 3 is embedded, by simultaneous moulding according to the technology described below, in the front portion 7 of frame 2. This technique is better, from the economic standpoint, than an alternative production technique according to which the frame 2 and the lens 3 are assembled together mechanically. With the latter method, frame 2 would be produced beforehand with a suitable groove or seating for lens 3, and this would then be mounted by force and held in place by suitable external elements, for example a vertical central clip having a function corresponding to that of the central bridge 10, which exerts traction between the opposite sides of frame 2 in the zone of the user's nose.

In all cases the front portion 7 of frame 2 surrounds the whole peripheral edge of lens 3 without a break. The C-shaped cross section of this front portion 7 ensures both hermeticity against ingress of water, and resistance to accidental disassembly of lens 3, while the holes 9 in the latter, filled with the material of frame 2 as explained below, define corresponding retaining pegs.

The preferred production technology for the goggles 1 according to the invention envisages separate production of lens 3, as mentioned, conveniently from transparent laminated sheets, of perfect optical properties. The successive stages are cutting and trimming of the sheet to the desired shape, machining of holes 9 or omega-shaped notches along the peripheral edge of the sheet, and then heat-forming according to the progressive curvature of the design. Internal treatments (antifogging, etc.) and external treatments (for scratch resistance, mirroring, etc.) can be effected before or after machining: they will, however, have to be of types that are not sensitive to the high temperatures that develop during simultaneous injection moulding of flexible frame 2.

As an alternative, lens 3 can be formed directly by injection in a suitable mould, and then submitted to chemical or mechanical treatments to achieve the desired characteristics.

The lens 3 thus formed is then placed in an injection mould for simultaneous moulding of frame 2 around the said lens. This operation requires the following steps:

- accurate positioning of the lens in the mould by robot or manually, making use of suitable position locators on the mould;
- holding of the lens in the mould prior to closure of the press, by suction cups or a suction system;
- the zones of the mould of frame 2 intended for sealing the lens 3 will necessarily have to be perfectly smooth, and preferably relieved, or tapered, in the central zone, so as not to cause deterioration of the lens part intended for vision (for example, if the lens is 1 mm thick, the walls of the mould can each be relieved by 0.5 mm),
- on the other hand the peripheral edges of the aforementioned zones of the mould will have to be loaded or made thicker by at least one or two tenths of a millimeter, both to prevent passage of burrs of thermoplastic material, and to lock the lens, preventing its translation and deformation due to the flow of injected material that is to constitute the frame 2. This will result in a slight incision ("coining") in the outer periphery of the lens zone that is free from the frame material, which is not at all troublesome for the aesthetic appearance and for vision.

In the case when the material of frame 2 is a thermoplastic elastomeric material, the technique of embedding lens 3 by simultaneous moulding will not require special measures, since the thermoplastic elastomers require, cooled moulds and this precludes the risk of thermal damage of the lens. On the other hand, when the material of frame 2 consists of a vulcanizable elastomeric material, which, as is well known, requires moulds heated between 120° and 220° C., there may be a problem of deformation of the lens during its dwell time in the mould. This problem is easily solved by thermal insulation and cooling of the zones of the mould that are involved in contact with the lens but are not involved in vulcanization of the elastomeric material.

In the case when it is intended to limit the transverse flexibility of the goggles 1 in their entirety, it will be possible to use stiffening elements, such as a transverse block in the front zone, or as already mentioned, a peripheral element completely or partially surrounding the periphery of the front portion 7 of frame 2. These stiffening elements can be joined to frame 2 by mechanical assembly or, more conveniently, they can be embedded during simultaneous moulding.

Moreover, for the purpose of improving the assembly and hermeticity of goggles 1, at the end of the production process described above it will be possible to envisage the use of a central vertical element in the form of a clip, not shown in the drawings, capable of replacing the vertical bridge 10 and shaped so as to prevent the zones of the front portion 7 of frame 2 corresponding to the centre of the user's forehead and root of the nose from moving away from the corresponding zones of lens 3.

ADVANTAGES OF THE INVENTION

The advantages resulting from the construction described above of goggles 1 according to the invention can be summarized as follows:

Savings in capital costs of moulds

The only equipment required (apart from the headband) comprises the tools for cutting and bending the lens 3, and the mould for simultaneous moulding of the soft frame 2. Compared with goggles according to the previously cited European patent application EP-A-0824029 there are savings of more complex and more expensive moulds corresponding to those of the rigid outer ring and the assembly devices.

Economical production

Just one operation of injection moulding is required—simultaneous moulding of the soft frame 2 on the peripheral edge of lens 3—which is moreover easily robotized. Practically finished goggles leave the mould—they only lack the headband 4.

No manual assembly

Still excluding the headband, assembly of the goggles does not envisage any additional operation of assembly that might involve a risk of dirtying or damaging the lens.

Support on the face that is neither harmful nor troublesome

The support provided by the rear portion 8 of frame 2 is entirely comfortable as it does not place any pressure on the soft parts in the orbital cavities of the user, and ensures complete hermeticity.

Panoramic vision

Vision during use is total from the extreme right to the extreme left of the goggles, it is without discontinuities, it is correct and not doubled in the central zone, while any small refractive aberrations are relegated to the extreme peripheral zones of the lens and so are not noticeable.

Adaptability to different shapes of face

The flexibility of the lens, which is absolutely gradual and is free from unexpected angulations that could cause discontinuities in underwater vision, permits immediate adaptability to faces of different widths. The goggles remain moderately flexible until they are fitted on the face, but once fitted they assume the geometry that is closer-fitting to the face, becoming practically non-deformable: the face itself becomes their "fourth wall", so that when they are being worn the visual image is steady and free from distortion.

It will of course be possible to vary the details of construction and the manner of realization, yet without leaving the scope of the present invention. For example, we should not exclude the possibility that the soft frame 2, instead of leaving the user's nose free, covers it completely, achieving support on the face directly on the upper lip, as in an ordinary underwater mask. Even in this case, the characteristic features of the invention will not be lost: flexible single lens 3 with progressive curvature, which ensures panoramic vision that is free from optical defects; flexible frame 2 with support on the face strictly outside of the orbital cavities and adaptable to very varied shapes of face; technology of embedding the single lens 3 in the flexible frame 2 by techniques of simultaneous moulding, ensuring extremely economical production with modest capital expenditure.

What is claimed is:

1. Goggles for swimming or diving (1) comprising:

a lens (3) shaped according to a cylindrical surface with substantially rectilinear vertical generating lines with progressively variable radius of curvature, much greater corresponding to the front portion and less corresponding to the lateral portions, a frame (2) carrying the lens (3) and substantially shaped and disposed according to the same cylindrical surface of the said lens (3), a surround (8) carried by the frame (2) and capable, in use, of being applied hermetically on the face of a user, positioning being such that during use the lens (3) is kept very close to the surface of the user's face, characterized in that:

the said frame (2) is formed from an annular body that is substantially flexible, made as a single piece with the said surround (8) by injection moulding of an elastomeric and preferably thermoplastic material, surround (8) has an annular shape that describes a single continuous perimeter, substantially in a horizontal figure-of-eight shape not closed at the centre, in use surrounding both eyes of the user, the said lens (3) consists of a substantially flexible sheet with a peripheral edge formed with a large number of through-holes **(9, 9*a*, 9*b*) and embedded hermetically by simultaneous moulding in the said frame (2)**.

2. Goggles according to claim 1, characterized in that the said frame (2) includes a front portion (7) integral with the said surround (8) and having a substantially C-shaped cross section, in which is inserted the said peripheral edge with through-holes **(9, 9*a*, 9*b*) of the said lens (3)**.

3. Goggles according to claim 1, characterized in that the said through-holes **(9*a*, 9*b*) are of larger size to correspond to the ends and the central zone of the said lens (3)**.

4. Goggles according to claim 1, characterized in that they include means for stiffening the frame (2).

5. Goggles according to claim 4, characterized in that the said stiffening means comprise a central bridge (10) formed as a single piece with the said frame (2) and arranged on opposite sides of the central zone of the said lens (3).

6. Goggles according to claim 1, characterized in that the said sheet (3) is single.

7. Goggles according to claim 1, characterized in that the said sheet (3) is double.

8. Goggles according to claim 1, characterized in that the said frame is shaped so as to cover the user's nose in the same manner as an underwater mask.

* * * * *